US011189243B2

(12) United States Patent
Tang et al.

(10) Patent No.: US 11,189,243 B2
(45) Date of Patent: Nov. 30, 2021

(54) SHIFT REGISTER UNIT, DRIVING METHOD THEREOF, GATE DRIVING CIRCUIT AND DISPLAY DEVICE

(71) Applicants: Hefei Xinsheng Optoelectronics Technology Co., Ltd., Anhui (CN); BOE Technology Group Co., Ltd., Beijing (CN)

(72) Inventors: Chuanjiang Tang, Beijing (CN); Tong Yang, Beijing (CN); Xianjie Shao, Beijing (CN)

(73) Assignees: Hefei Xinsheng Optoelectronics Technology Co., Ltd., Hefei (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/829,263

(22) Filed: Mar. 25, 2020

(65) Prior Publication Data

US 2021/0065647 A1 Mar. 4, 2021

(30) Foreign Application Priority Data

Aug. 29, 2019 (CN) ..... 201910809394.8

(51) Int. Cl.
*G09G 3/36* (2006.01)

(52) U.S. Cl.
CPC ... *G09G 3/3696* (2013.01); *G09G 2310/0286* (2013.01); *G09G 2310/08* (2013.01)

(58) Field of Classification Search
CPC ..... G09G 3/3696; G09G 2310/0286; G09G 2310/08
See application file for complete search history.

(56) References Cited

U.S. PATENT DOCUMENTS 3,824,478 A * 7/1974 Mueller ..... G11C 19/18 377/79
10,838,259 B2 * 11/2020 Mori ..... G02F 1/1368
2006/0238696 A1 * 10/2006 Wen ..... C09K 19/0403 349/187
2010/0244946 A1 * 9/2010 Murakami ..... H03K 17/693 327/564
2011/0134090 A1 * 6/2011 Iwamoto ..... G09G 3/3677 345/206
2015/0153862 A1 * 6/2015 Nakamura ..... G06F 3/041 345/173
2015/0213762 A1 * 7/2015 Xia ..... G09G 3/3266 345/215

* cited by examiner

*Primary Examiner* — Christopher E Leiby
(74) *Attorney, Agent, or Firm* — Arent Fox LLP; Michael Fainberg

(57) ABSTRACT

A shift register unit, a driving method thereof, a gate driving circuit, and a display device. The shift register unit comprises an input circuit, a control circuit, a reset circuit, an output circuit and a first capacitor, where the input circuit provides a signal from an input signal terminal to a first node; the control circuit controls signals from the first node and a second node; the reset circuit provides a signal from a reference signal terminal to the first node; the output circuit provides a signal from a clock signal terminal to a signal output terminal, and provides the signal from the reference signal terminal to the signal output terminal; and the first capacitor is coupled between the clock signal terminal and the second node.

18 Claims, 11 Drawing Sheets

SHIFT REGISTER UNIT, DRIVING METHOD THEREOF, GATE DRIVING CIRCUIT AND DISPLAY DEVICE

CROSS-REFERENCE TO RELATED APPLICATION

This application claims priority of Chinese Patent Application No. 201910809394.8, filed on Aug. 29, 2019, which is hereby incorporated by reference in its entirety.

FIELD

The present disclosure relates to the field of display technology, and particularly relates to a shift register unit, a driving method thereof, a gate driving circuit, and a display device.

BACKGROUND

With the rapid development of display technologies, display devices are increasingly developing towards high integration and low cost, where a GOA (Gate Driver on Array) technology integrates a TFT (Thin Film Transistor) gate driving circuit on an array substrate of a display device to achieve scanning drive of the display device, and the gate driving circuit is generally composed of a plurality of shift register units cascaded.

SUMMARY

An embodiment of the present disclosure provides a shift register unit, the shift register unit including:

an input circuit configured to provide a signal from an input signal terminal to a first node in response to the signal from the input signal terminal;

a control circuit configured to control signals from the first node and a second node;

a reset circuit configured to provide a signal from a reference signal terminal to the first node in response to a signal from a reset signal terminal;

an output circuit configured to provide a signal from a clock signal terminal to a signal output terminal in response to the signal from the first node, and provide the signal from the reference signal terminal to the signal output terminal in response to the signal from the second node; and a first capacitor coupled between the clock signal terminal and the second node.

Optionally, in an embodiment of the present disclosure, a dielectric layer of the first capacitor is made from a liquid crystal material.

Optionally, in an embodiment of the present disclosure, the input circuit includes a first transistor, the first transistor having a gate coupled to the input signal terminal, a first electrode coupled to the input signal terminal, and a second electrode coupled to the first node; and/or the control circuit includes a second transistor and a third transistor, the second transistor having a gate coupled to the second node, a first electrode coupled to the reference signal terminal, and a second electrode coupled to the first node; and the third transistor having a gate coupled to the first node, a first electrode coupled to the reference signal terminal, and a second electrode coupled to the second node.

Optionally, in an embodiment of the present disclosure, the reset circuit includes a fourth transistor, the fourth transistor having a gate coupled to the reset signal terminal, a first electrode coupled to the reference signal terminal, and a second electrode coupled to the first node; and/or the output circuit includes a fifth transistor, a sixth transistor and a second capacitor, the fifth transistor having a gate coupled to the first node, a first electrode coupled to the clock signal terminal, and a second electrode coupled to the signal output terminal;

the sixth transistor having a gate coupled to the second node, a first electrode coupled to the reference signal terminal, and a second electrode coupled to the signal output terminal; and the second capacitor being coupled between the first node and the signal output terminal.

Optionally, in an embodiment of the present disclosure, a dielectric layer of the second capacitor is made from a liquid crystal material.

Optionally, in an embodiment of the present disclosure, the shift register unit further includes a frame reset circuit, the frame reset circuit being configured to provide the signal from the reference signal terminal to the first node and the signal output terminal respectively in response to a signal from a frame reset signal terminal.

Optionally, in an embodiment of the present disclosure, the frame reset signal terminal includes a seventh transistor and an eighth transistor, the seventh transistor having a gate coupled to the frame reset signal terminal, a first electrode coupled to the reference signal terminal, and a second electrode coupled to the first node; and the eighth transistor having a gate coupled to the frame reset signal terminal, a first electrode coupled to the reference signal terminal, and a second electrode coupled to the signal output terminal.

Correspondingly, an embodiment of the present disclosure further provides a gate driving circuit, the gate driving circuit including a plurality of the above shift register units cascaded;

an input signal terminal of a first-level shift register unit is coupled to a frame trigger signal terminal;

in every two adjacent levels of shift register units, an input signal terminal of a next-stage shift register unit is coupled to a signal output terminal of a prior-stage shift register unit; and in every two adjacent levels of shift register units, an output signal terminal of a next-stage shift register unit is coupled to a reset signal terminal of a prior-stage shift register unit.

Correspondingly, an embodiment of the present disclosure further provides a display device, the display device including the above gate driving circuit.

Optionally, in an embodiment of the present disclosure, the displays device further includes: an array substrate and an opposite substrate arranged opposite to each other, a liquid crystal layer encapsulated between the array substrate and the opposite substrate, a first electrode layer located between the liquid crystal layer and the array substrate, and a clock signal line electrically connected to the clock signal terminal;

the first electrode layer includes first electrodes and second electrodes in one-to-one corresponding to the shift register units, where in the same shift register unit, the first electrodes are electrically connected to the clock signal line, and the second electrodes are electrically connected to the second node; and in the same shift register unit, the first electrode, the second electrode and the liquid crystal layer are equivalent to the first capacitor.

Optionally, in an embodiment of the present disclosure, the first electrodes and the second electrodes are respectively interdigitated electrodes.

Optionally, in an embodiment of the present disclosure, the display device further includes a second electrode layer arranged to be insulated from the first electrode layer;

the second electrode layer includes third electrodes and fourth electrodes in one-to-one corresponding to the shift register units, where in the same shift register unit, the third electrode is electrically connected to the first node, and the fourth electrode is electrically connected to the signal output terminal; and in the same shift register unit, the third electrode, the fourth electrode and the liquid crystal layer are equivalent to the second capacitor.

Optionally, in an embodiment of the present disclosure, the third electrode and the fourth electrode are respectively interdigitated electrodes.

Correspondingly, an embodiment of the present disclosure further provides a driving method of the above shift register unit, the driving method including:

in an input phase, providing, by the input circuit, the signal from the input signal terminal to the first node in response to the signal from the input signal terminal; controlling, by the control circuit, the signals from the first node and the second node; providing, by the output circuit, the signal from the clock signal terminal to the signal output terminal in response to the signal from the first node; and storing, by the first capacitor, voltages of the signals from the second node and the clock signal terminal;

in an output phase, providing, by the output circuit, the signal from the clock signal terminal to the signal output terminal in response to the signal from the first node; controlling, by the control circuit, the signals from the first node and the second node; and storing, by the first capacitor, voltages of the signals from the second node and the clock signal terminal;

in a reset phase, providing, by the reset circuit, the signal from the reference signal terminal to the first node in response to the signal from the reset signal terminal; and storing, by the first capacitor, voltages of the signals from the second node and the clock signal terminal; and in a reset-maintaining phase, keeping, by the first capacitor, a voltage difference between the second node and the clock signal terminal stable; and providing, by the output circuit, the signal from the reference signal terminal to the signal output terminal in response to the signal from the second node.

DETAILED DESCRIPTION OF THE EMBODIMENTS

Although signal output can be achieved by inputting many control signals with different functions, this requires a large number of transistors in a shift register unit, and a complicated structure of connections between the transistors, thus increasing process difficulty and manufacturing cost.

To make the object, technical solutions and advantages of the present disclosure more apparent, specific implementations of a shift register unit, a driving method thereof, a gate driving circuit and a display device provided by embodiments of the present disclosure are described in detail below in combination with accompanying drawings. It should be understood that the preferred embodiments described below are only used for illustrating and explaining the present disclosure, instead of limiting the present disclosure. Moreover, the embodiments in the present disclosure and the features in the embodiments can be combined with each other under the condition of no confliction.

Figure 1A:
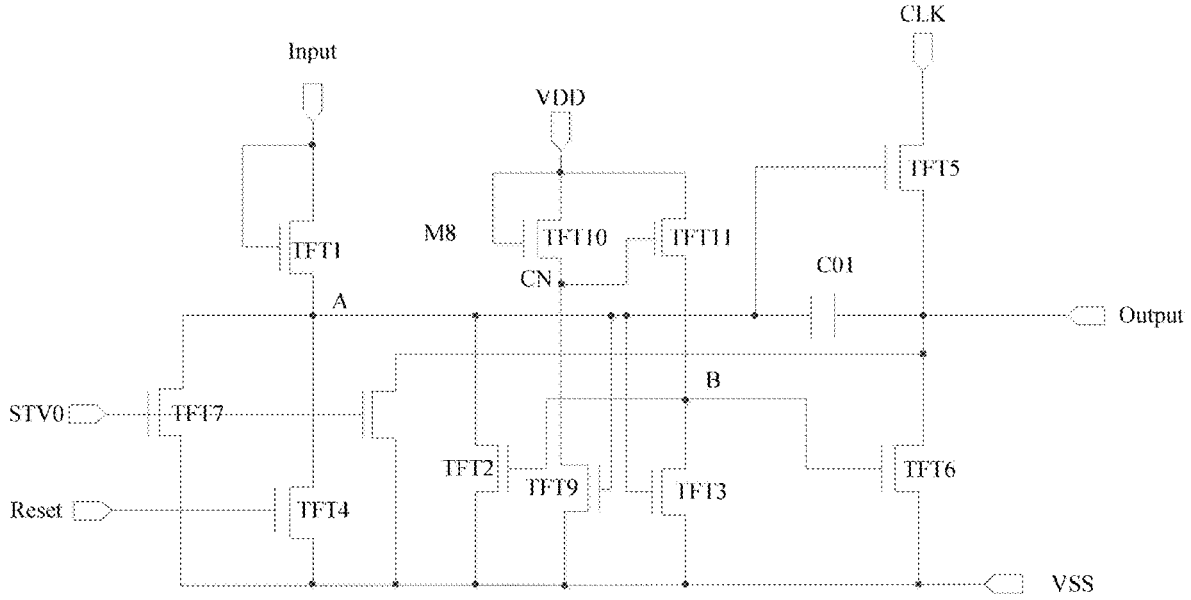
FIG. 1*a* is a structural schematic diagram of a shift register unit in the related art.
Figure 1B:
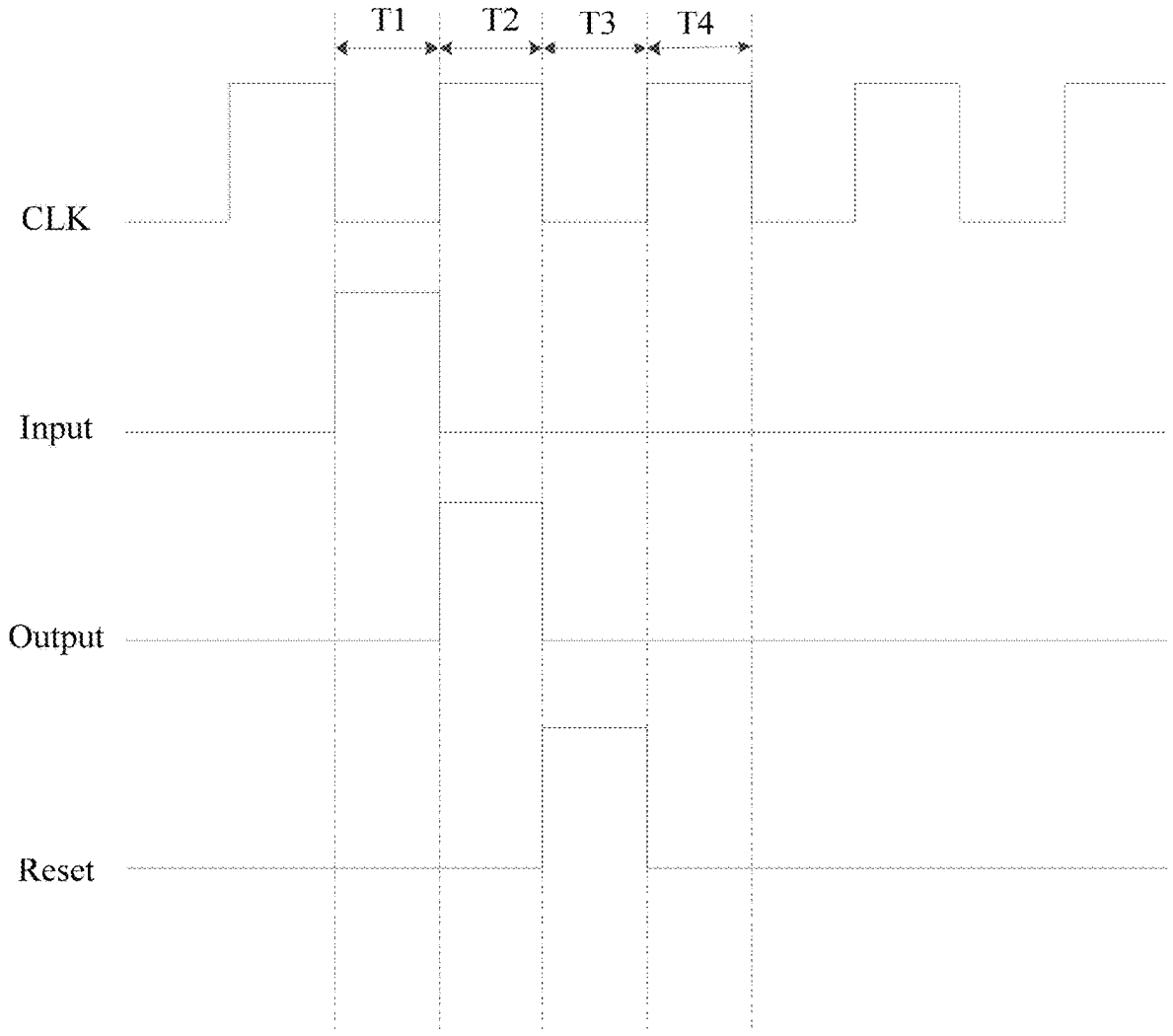
FIG. 1*b* is an input and output timing diagram of the shift register unit shown in FIG. 1*a;*

FIG. 1*a* is a structural schematic diagram of a shift register unit in the related art. The shift register unit includes first to eleventh switching transistors (TFT1-TFT11) and a capacitor C01. A timing diagram corresponding to the shift register unit shown in FIG. 1*a* is as shown in FIG. 1*b*. Through mutual cooperation of the first to eleventh switching transistors (TFT1-TFT11) and the capacitor C01, a signal output terminal Output can output a signal, and a specific working process of which is not described in detail here. A signal from a first signal terminal VSS is a low-level signal, and a signal from a second signal terminal VDD is a high-level signal. In part of the working process, the tenth switching transistor TFT10 is turned on under the control of the signal from the second signal terminal VDD to provide the signal from the second signal terminal VDD to a gate of the eleventh switching transistor TFT11, thereby controlling the tenth switching transistor TFT11 to be turned on. The turned-on eleventh switching transistor TFT11 provides the signal from the second signal terminal VDD to a node B, to control a level of a signal from the node B to be a high level. The node B can control the sixth switching transistor TFT6 to be turned on to provide the signal from the first signal terminal VSS to the signal output terminal Output. Therefore, at least two transistors need to be provided to pull up the level of the node B. As a result, the number of transistors in the shift register unit is large, which makes the process more difficult and increases a manufacturing cost.

Figure 2:
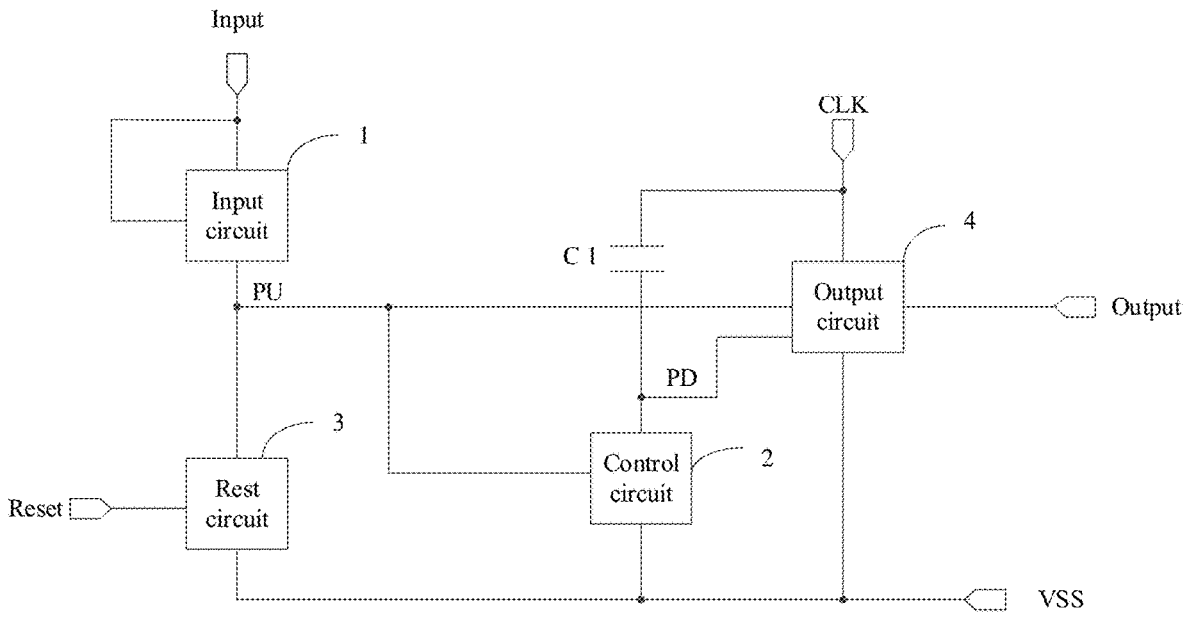
FIG. 2 is a first structural schematic diagram of a shift register unit provided by an embodiment of the present disclosure.

In view of this, an embodiment of the present disclosure provides a shift register unit, as shown in FIG. 2, including an input circuit 1, a control circuit 2, a reset circuit 3, an output circuit 4 and a first capacitor C1;

the input circuit 1 is configured to provide a signal from an input signal terminal Input to a first node PU in response to the signal from the input signal terminal Input;

the control circuit 2 is configured to control signals from the first node PU and a second node PD;

the reset circuit 3 is configured to provide a signal from a reference signal terminal VSS to the first node PU in response to a signal from a reset signal terminal Reset;

the output circuit 4 is configured to provide a signal from a clock signal terminal CLK to a signal output terminal Output in response to the signal from the first node PU, and provide the signal from the reference signal terminal VSS to the signal output terminal Output in response to the signal from the second node PD; and the first capacitor C1 is coupled between the clock signal terminal CLK and the second node PD.

The shift register unit provided by the embodiment of the present disclosure includes an input circuit, a control circuit, a reset circuit, an output circuit and a first capacitor, where the input circuit is configured to provide a signal from an input signal terminal to a first node in response to the signal from the input signal terminal; the control circuit is configured to control signals from the first node and a second node; the reset circuit is configured to provide a signal from a reference signal terminal to the first node in response to a signal from a reset signal terminal; the output circuit is configured to provide a signal from a clock signal terminal to a signal output terminal in response to the signal from the first node, and provide the signal from the reference signal terminal to the signal output terminal in response to the signal from the second node; and the first capacitor is coupled between the clock signal terminal and the second node. Therefore, in the shift register unit provided by the embodiment of the present disclosure, through mutual cooperation of the input circuit, the control circuit, the reset circuit, the output circuit and the first capacitor, the level of the signal from the second node can be controlled through the first capacitor in a reset-maintaining phase, and then the output circuit is controlled through the signal from the second node, so that the signal output terminal stably outputs a signal. Moreover, when the device in which the shift register unit is located is at a high temperature, the service life of the shift register unit can be prolonged. Furthermore, the shift register unit of the present disclosure can achieve the control of the second node in the reset-maintaining phase only by using the first capacitor. Compared with controlling the second node by using at least two transistors, the shift register unit is simple in structure, can reduce the process complexity and the manufacturing cost, and is beneficial to achieving a narrow frame design of a panel in a display device.

In specific implementation, in the shift register unit provided by the embodiment of the present disclosure, an effective pulse signal from the input signal terminal is a high-level signal, and the signal from the reference signal terminal VSS is a low-level signal; or, the effective pulse signal from the input signal terminal is a low-level signal, and the signal from the reference signal terminal VSS is a high-level signal.

The present disclosure is described in detail below in combination with specific embodiments. It should be noted that the embodiments are intended to better explain the present disclosure, but do not limit the present disclosure.

Figure 3:
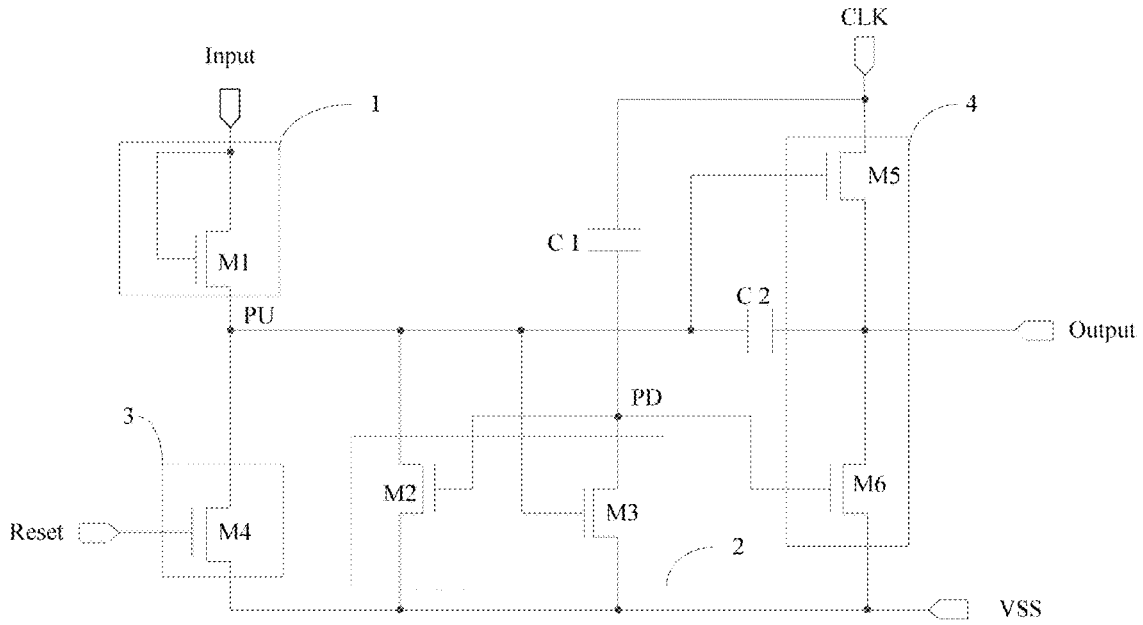
FIG. 3 is a second structural schematic diagram of a shift register unit provided by an embodiment of the present disclosure.

In specific implementation, in the shift register unit provided by the embodiment of the present disclosure, as shown in FIG. 3, the input circuit 1 includes a first transistor M1, the first transistor M1 having a gate coupled to the input signal terminal Input, a first electrode coupled to the input signal terminal Input, and a second electrode coupled to the first node PU.

In specific implementation, in the shift register unit provided by the embodiment of the present disclosure, as shown in FIG. 3, the control circuit 2 includes a second transistor M2 and a third transistor M3, the second transistor M2 having a gate coupled to the second node PD, a first electrode coupled to the reference signal terminal VSS, and a second electrode coupled to the first node PU, and the third transistor M3 having a gate coupled to the first node PU, a first electrode coupled to the reference signal terminal VSS, and a second electrode coupled to the second node PD.

In specific implementation, in the shift register unit provided by the embodiment of the present disclosure, as shown in FIG. 3, the reset circuit 3 includes a fourth transistor M4, the fourth transistor M4 having a gate coupled to the reset signal terminal Reset, a first electrode coupled to the reference signal terminal VSS, and a second electrode coupled to the first node PU.

In specific implementation, in the shift register unit provided by the embodiment of the present disclosure, as shown in FIG. 3, the output circuit 4 includes a fifth transistor M5, a sixth transistor M6 and a second capacitor C2, the fifth transistor M5 having a gate coupled to the first node PU, a first electrode coupled to the clock signal terminal CLK, and a second electrode coupled to the signal output terminal Output; the sixth transistor M6 having a gate coupled to the second node PD, a first electrode coupled to the reference signal terminal VSS, and a second electrode coupled to the signal output terminal Output; and the second capacitor C2 being coupled between the first node PU and the signal output terminal Output.

Figure 4:
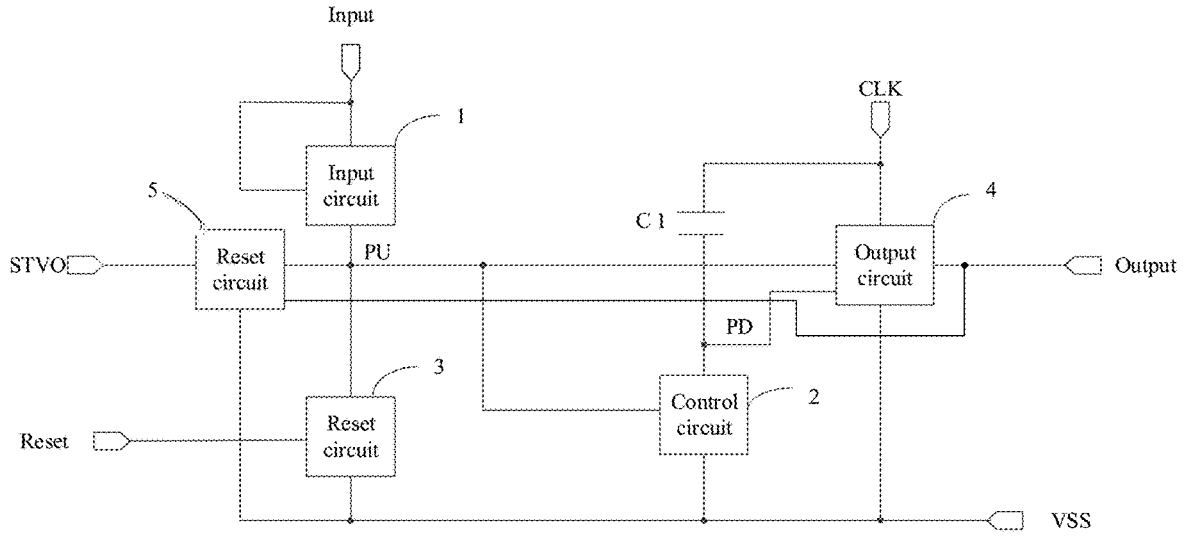
FIG. 4 is a third structural schematic diagram of a shift register unit provided by an embodiment of the present disclosure.

In specific implementation, in the shift register unit provided by the embodiment of the present disclosure, as shown in FIG. 4, the shift register unit further includes a frame reset circuit 5 configured to provide the signal from the reference signal terminal VSS to the first node PU and the signal output terminal Output respectively in response to a signal from a frame reset signal terminal STVO.

Figure 5:
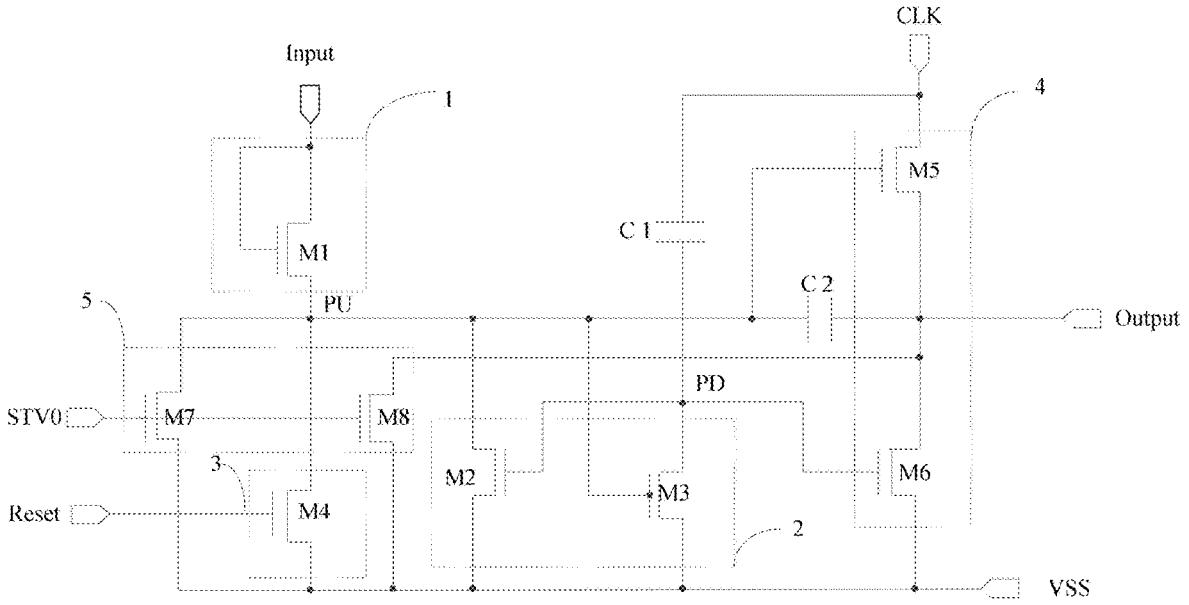
FIG. 5 is a fourth structural schematic diagram of a shift register unit provided by an embodiment of the present disclosure.

In specific implementation, in the shift register unit provided by the embodiment of the present disclosure, as shown in FIG. 5, the frame reset circuit 5 includes a seventh transistor M7 and an eighth transistor M8, the seventh transistor M7 having a gate coupled to the frame reset signal terminal STVO, a first electrode coupled to the reference signal terminal VSS, and a second electrode coupled to the first node PU, and the eighth transistor M8 having a gate coupled to the frame reset signal terminal STVO, a first electrode coupled to the reference signal terminal VSS, and a second electrode coupled to the signal output terminal Output.

In specific implementation, in the shift register provided by the embodiment of the present disclosure, the above transistors are illustrated by taking P-type transistors as an example. Under the condition that the above transistors are N-type transistors, the design principle is same as that of the present disclosure, and it also falls into the protection scope of the present disclosure.

Exemplarily described above are only specific structures of the circuits in the shift register unit provided by the embodiment of the present disclosure. In specific implementation, the specific structures of the above circuits are not limited to the above structures provided by the embodiment of the present disclosure, and may also be other structures known to those skilled in the art, and are not limited herein.

Figure 6:
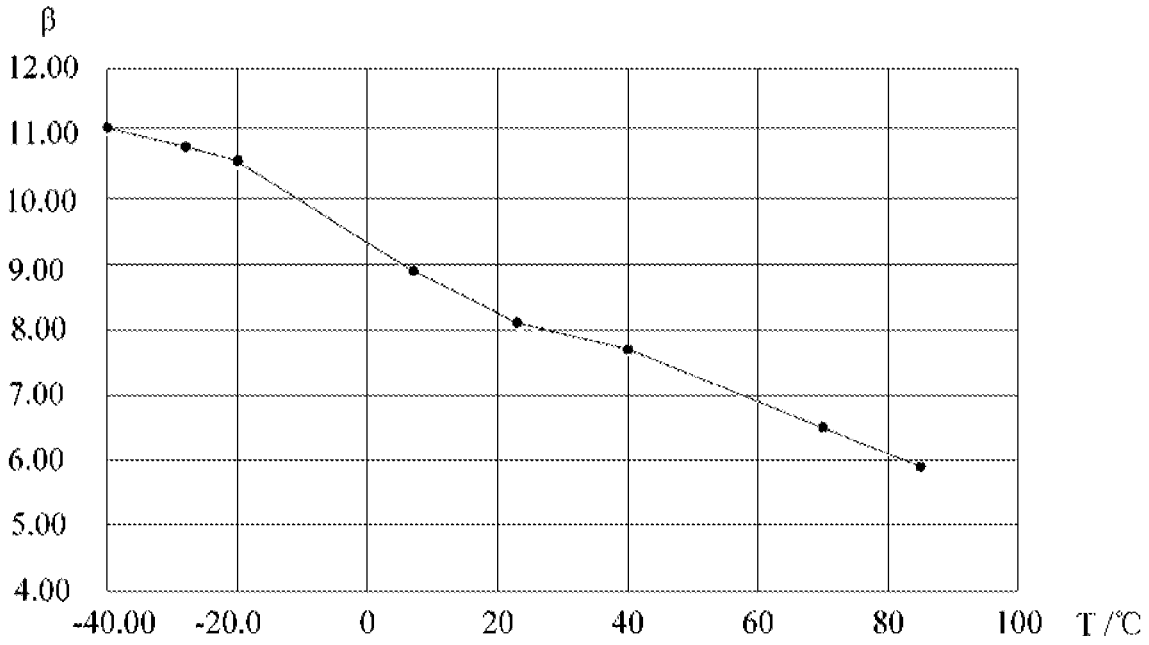
FIG. 6 is a schematic diagram of a rule of change of a dielectric constant of a liquid crystal material with temperature provided by an embodiment of the present disclosure.

Generally, a dielectric constant of a liquid crystal material changes with temperature. FIG. 6 shows a schematic diagram of a rule of change of a dielectric constant of the liquid crystal material with temperature. As can be seen from FIG. 6, the dielectric constant β of the liquid crystal material decreases with rising of temperature T.

Figure 7:
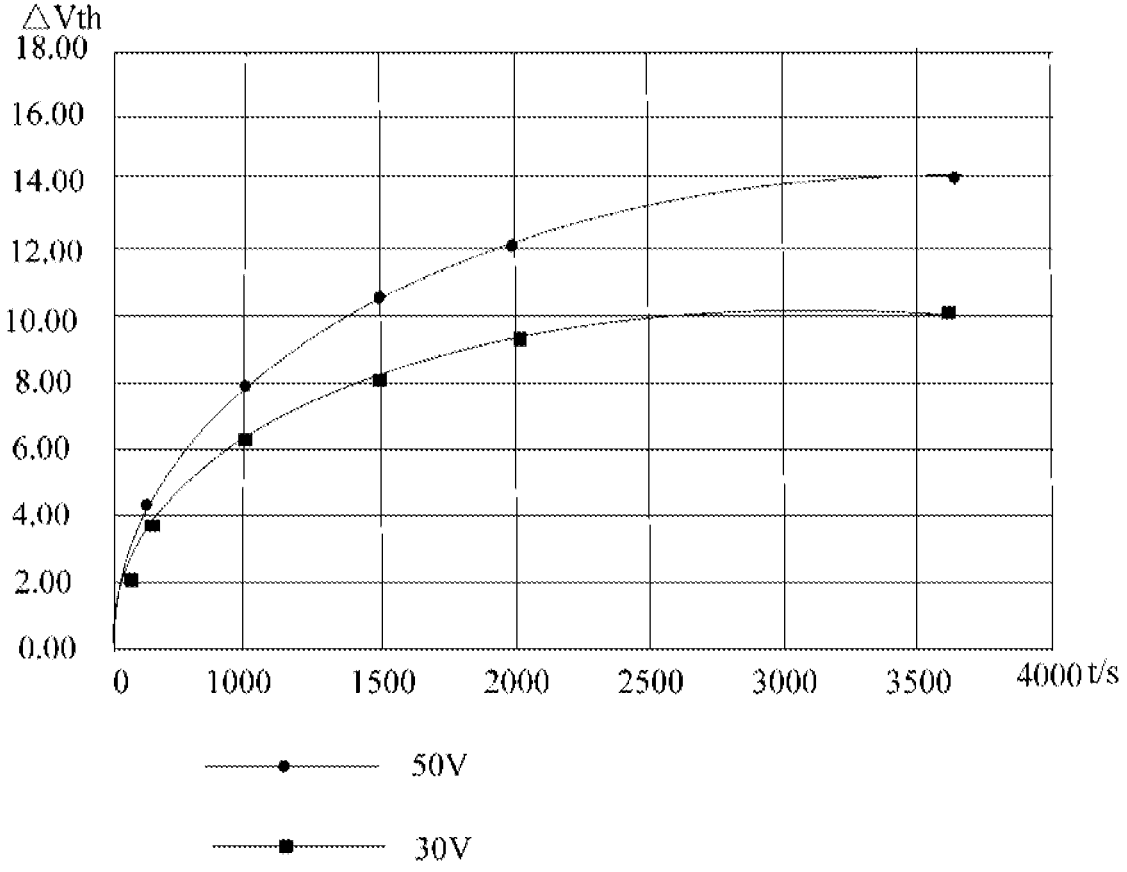
FIG. 7 is a schematic diagram of a rule of change of a drift speed of a threshold voltage of a transistor with gate voltages provided by an embodiment of the present disclosure.

Generally, a threshold voltage of a transistor changes with operating time under the control of different gate voltages, and FIG. 7 is a schematic diagram of a rule of change of a threshold voltage of a transistor with operating time under different gate voltages. It can be seen from FIG. 7 that at the same time t, as the gate voltage of the transistor rises, a change amount ΔVth of the threshold voltage of the transistor increases, thereby causing a drift speed of the threshold voltage of the transistor to increase. In addition, the change amount of the threshold voltage of the transistor also satisfies the following formula:

$$\Delta V_{th}=V_g-V_{thi})^a\{-\exp[-(t/\tau)^\beta]\},$$

where $V_g$ represents the gate voltage of the transistor, $\Delta V_{th}$ represents the change amount of the threshold voltage of the transistor, $V_{thi}$ represents an initial threshold voltage of the transistor, a is a fitted value related to surface features, β is a temperature-dependent stretched exponential function coefficient, and τ is carrier feature injection time.

In specific implementation, in the shift register unit provided by the embodiment of the present disclosure, a dielectric layer of the first capacitor C1 is made from a liquid crystal material. As the dielectric layer of the first capacitor C1 is made from a liquid crystal material, the dielectric constant of the liquid crystal material decreases when the temperature of a device in which the first capacitor C1 is located rises, and thus a capacitance value of the first capacitor C1 decreases. A voltage of the second node PD satisfies the following formula:

$$V_{PD} = \frac{(v_{gh} - v_{gl}) \times c_1}{c_1 + C_{gs_M3} + C_{gs_M2} + C_{gs_M6}}$$

where $V_{PD}$ represents PD represents the voltage of the second node PD, $v_{gh}$ represents a voltage value of a high-level signal, $v_{gl}$ represents a voltage value of a low-level signal, $c_1$ represents a capacitance value of the first capacitor C1, $C_{gs\text{-}M2}$ represents a capacitance value of a coupling capacitance between a gate and a source of the second transistor M2, $C_{gs\text{-}M3}$ represents a capacitance value of a coupling capacitance between a gate and a source of the third transistor M3, and $C_{gs\text{-}M6}$ represents a capacitance value of a coupling capacitance between a gate and a source of the sixth transistor M6. As the voltage of the second node PD decreases, the voltages of the gates of the second transistor M2 and the sixth transistor M6 decrease, and the change amounts of threshold voltages of the second transistor M2 and the sixth transistor M6 decrease, and therefore the stability of the transistors is improved, and further the service life of the shift register unit is prolonged.

Thus, when the temperature of the device in which the shift register unit is located rises, the voltage value of the signal from the second node is controlled to decrease through the first capacitor, so that the gate voltages of the transistors coupled to the second node also decrease, and further the change amounts of the threshold voltages of the transistors also decrease, and therefore the stability of the transistors is improved, the signal output terminal stably outputs a signal, and the service life of the shift register unit is prolonged.

Further, in specific implementation, in the shift register unit provided by the embodiment of the present disclosure, the dielectric layer of the second capacitor C2 may be made from the liquid crystal material. As the dielectric layer of the second capacitor C2 is made from the liquid crystal material, the dielectric constant of the liquid crystal material decreases when the temperature of a device in which the second capacitor C2 is located rises, and thus a capacitance value of the second capacitor C2 decreases. A voltage of the first node PU satisfies the following formula:

$$V_{PU} = V_{gh} + \frac{(V_{gh} - V_{gl}) \times c_2}{c_2 + c_{gs_M1} + c_{gs_M2} + c_{gs_M3} + c_{gs_M4} + c_{gs_M5} + c_{gs_M6}};$$

where $V_{PU}$ represents the voltage of the first node PU, $v_{gh}$ represents the voltage value of the high-level signal, $v_{gl}$ represents the voltage value of the low-level signal, $c_2$ represents a capacitance value of the second capacitor C2, $C_{gs\text{-}M1}$ represents a capacitance value of a coupling capacitance between a gate and a source of the first transistor M1, $C_{gs\text{-}M2}$ represents the capacitance value of the coupling capacitance between the gate and the source of the second transistor M2, $C_{gs\text{-}M3}$ represents the capacitance value of the coupling capacitance between the gate and the source of the third transistor M3, $C_{gs\text{-}M4}$ represents a capacitance value of a coupling capacitance between a gate and a source of the fourth transistor M4, $C_{gs\text{-}M5}$ represents a capacitance value of a coupling capacitance between a gate and a source of the fifth transistor M5, and $C_{gs\text{-}M6}$ represents the capacitance value of the coupling capacitance between the gate and the source of the sixth transistor M6. As the voltage of the first node PU decreases, the voltages of the gates of the third transistor M3 and the fifth transistor M5 decrease. According to the above formula, the change amounts of threshold voltages of the third transistor M3 and the fifth transistor M5 decrease, so that the stability of the transistors is improved, and further the service life of the shift register unit is prolonged.

Thus, when the temperature of the device in which the shift register unit is located rises, the voltage value of the signal from the first node is controlled to decrease through the second capacitor, so that the gate voltages of the transistors coupled to the first node also decrease, and further the change amounts of the threshold voltages of the transistors also decrease, therefore the stability of the transistors is improved to enable the signal output terminal to stably output a signal, and the service life of the shift register unit is prolonged.

To simplify a preparation process, in the shift register unit provided by the embodiment of the present disclosure, as shown in FIGS. 3 and 5, the transistors may be P-type transistors. Of course, the transistors may also be N-type transistors, which is not limited herein.

Optionally, in the shift register unit provided by the embodiment of the present disclosure, a P-type transistor is turned on under the effect of a low-level signal and is turned off under the effect of a high-level signal; and an N-type transistor is turned on under the effect of a high-level signal and is turned off under the effect of a low-level signal.

Optionally, in the shift register provided by the embodiment of the present disclosure, the above transistors may be thin film transistors (TFTs), and may also be metal oxide semiconductor field effect transistors (MOSs), which is not limited herein. Depending on different types of the above transistors and different signals from the gates of the transistors, first electrodes of the above transistors can be used as sources and second electrodes of the above transistors can be used as drains, or the first electrodes of the above transistors can be used as drains and the second electrodes of the above transistors can be used as sources, which are not differentiated specifically herein.

A working process of the shift register unit provided by the embodiment of the present disclosure is described below in combination with a circuit timing diagram. In the following description, 1 represents a high level, and 0 represents a low level. It should be noted that 1 and 0 are logic levels, which are only for better explaining the specific working process of the embodiment of the present disclosure, rather than specific voltage values.

Figure 8:
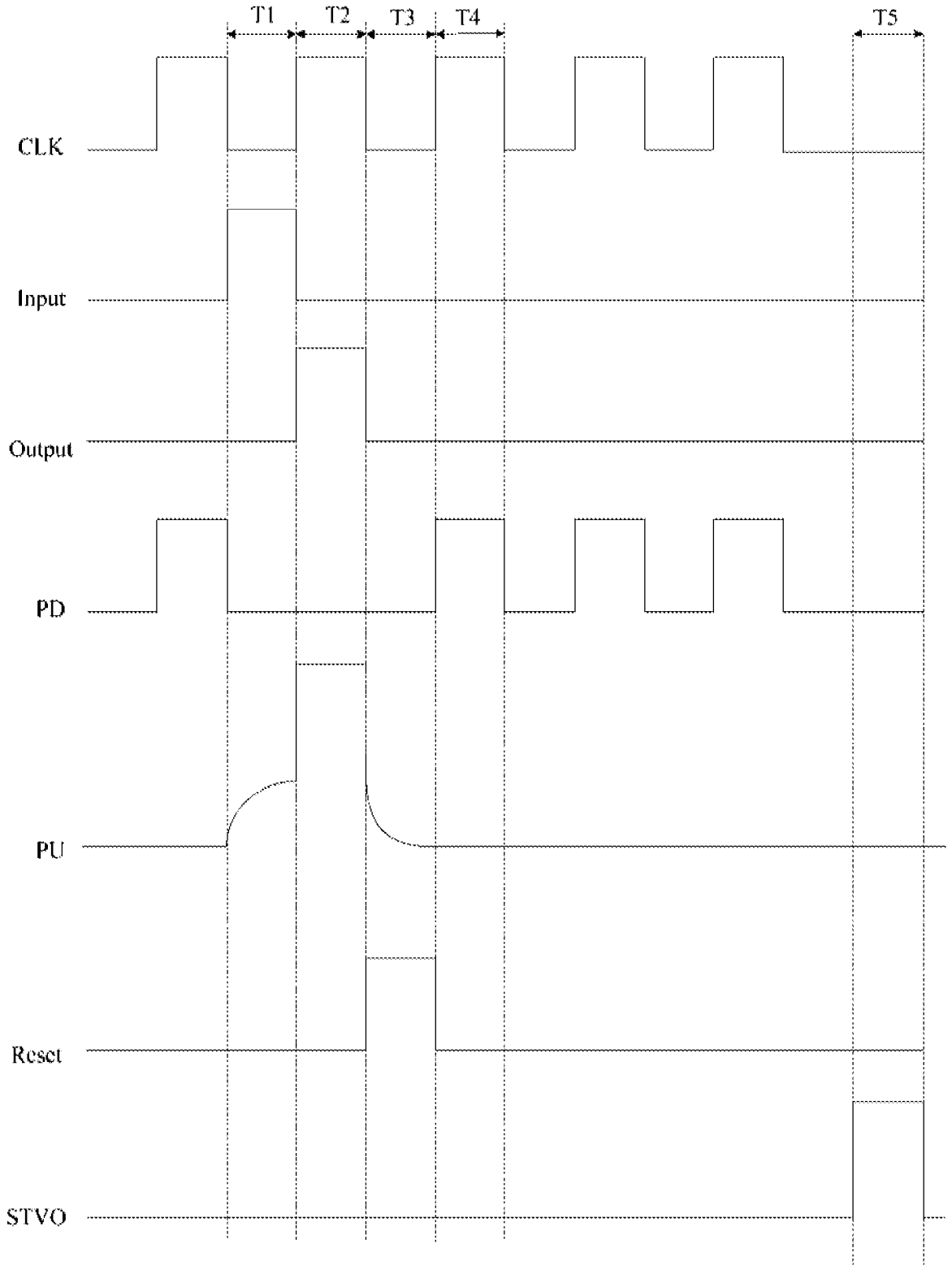
FIG. 8 is an input and output timing diagram of the shift register unit shown in FIG. 5.

By taking the shift register unit shown in FIG. 5 as an example, a corresponding input and output timing diagram is shown in FIG. 8. FIG. 8 shows an input phase T1, an output phase T2, a reset phase T3 and a reset-maintaining phase T4 in the input and output timing diagram. The signal from the first reference signal terminal VSS has a low level.

In the input phase T1, Input=1, CLK=0, and Reset=0.

Due to Reset=0, the fourth transistor M4 is turned off. Due to Input=1, the first transistor M1 is turned on. The turned-on first transistor M1 provides the signal from the signal input terminal Input to the first node PU, so that the signal from the first node PU is a high-level signal, and the second capacitor C2 can be charged; and the first node PU can control the fifth transistor M5 to be turned on, so that the turned-on fifth transistor M5 provides a low-level signal from the clock signal terminal CLK to the signal output terminal Output. The first node PU can also control the third transistor M3 to be turned on, so that the turned-on third transistor M3 provides the low-level signal from the reference signal terminal VSS to the second node PD, and the signal from the second node PD is a low-level signal, and also the second node PD can control the second transistor M2 and the sixth transistor M6 to be turned off.

In the output phase T2, Input=0, CLK=1, and Reset=0.

Due to Reset=0, the fourth transistor M4 is turned off. Due to Input=0, the first transistor M1 is turned off. Therefore, the first node PU is in a floating state. Due to the effect of the second capacitor C2, the high-level signal can be maintained at the first node PU to control the fifth transistor M5 to be turned on, so that the turned-on fifth transistor M5 provides the high-level signal from the clock signal terminal CLK to the signal output terminal Output. Due to the effect of the second capacitor C2, the level of the signal from the first node PU can be further pulled up, so that the fifth transistor M5 and the third transistor M3 are completely turned on as much as possible. The fifth transistor M5 that is completely turned on as much as possible can provide the high-level signal from the clock signal terminal CLK to the signal output terminal Output without voltage loss as much as possible. The turned-on third transistor M3 provides the low-level signal from the reference signal terminal VSS to the second node PD, so that the signal from the second node PD is a low-level signal, and also the second node PD can control the second transistor M2 and the sixth transistor M6 to be turned off.

In the reset phase T3, Input=0, CLK=0, and Reset=1.

Due to Input=0, the first transistor M1 is turned off. Due to Reset=1, the fourth transistor M4 is turned on, and the turned-on fourth transistor M4 can provide the low-level signal from the reference signal terminal VSS to the first node PU, so that the second capacitor can be discharged, and the level of the signal from the first node PU slowly decreases. During the slowly decreasing process of the level of the signal from the first node PU, the first node PU can control the third transistor M3 and the fifth transistor M5 to be turned on, so that the third transistor M3 provides the low-level signal from the reference signal terminal VSS to the second node PD, further the level of the signal from one end, coupled to the second node PD, of the first capacitor C1 is pulled down, and therefore signals from two ends of the first capacitor C1 are low-level signals. When the signal from the first node PU decreases to be the low-level signal, the first node PU can control the third transistor M3 and the fifth transistor M5 to be turned off. Since the signal from the second node PD is pulled down to be the low-level signal, the second node PD can control the second transistor M2 and the sixth transistor M6 to be turned off.

In the reset-maintaining phase T4, Input=0, CLK=1, and Reset=0.

Due to Input=0 and Reset=0, the first transistor M1 is turned off, and the fourth transistor M4 is turned off. Since the signal from the clock signal terminal CLK is the high-level signal, the signal from one end, coupled to the clock signal terminal CLK, of the first capacitor C1 is the high-level signal. Due to a bootstrapping effect of the first capacitor, the signal from the other end of the first capacitor C1, that is, the end coupled to the second node PD is the high-level signal, so that the signal from the second node PD controls the sixth transistor M6 and the second transistor M2 to be turned on. The turned-on sixth transistor M6 can provide the signal from the reference signal terminal VSS to the signal output terminal Output, and the turned-on second transistor M2 can provide the signal from the reference signal terminal VSS to the first node PU, so that the signal from the first node PU is the low-level signal to turn off the third transistor M3 and the fifth transistor M5. When the temperature of the device in which the shift register unit is located rises, the change amounts ΔVth of the threshold voltages of the second transistor M2 and the sixth transistor M6 increase. In the present disclosure, as the dielectric layer of the first capacitor C1 is made from the liquid crystal material, the dielectric constant of the liquid crystal material decreases when the temperature rises, thus the capacitance value of the first capacitor C1 decreases, further the voltage of the second node PD is reduced, the voltages of the gates of the second transistor M2 and the sixth transistor M6 decreases accordingly, and the change amounts ΔVth of the threshold voltages of the second transistor M2 and the sixth transistor M6 decrease, and therefore the stability of the second transistor M2 and the sixth transistor M6 is improved to enable the signal output terminal to stably output the signal, and the service life of the shift register unit is prolonged.

A frame reset phase T5 may also be set before the input phase T1 or after the reset-maintaining phase T4, where Input=0, CLK=0, Reset=0, and STVO=1.

Due to Input=0, CLK=0, and Reset=0, the first transistor M1 and the fourth transistor M4 are turned off. Since the signal from the frame reset terminal STVO is the high-level signal, the seventh transistor M7 and the eighth transistor M8 are turned on, and the turned-on seventh transistor M7 provides the signal from the reference signal terminal VSS to the first node PU, so that the signal from the first node PU is the low-level signal, and further the first node PU can control the third transistor M3 and the fifth transistor M5 to be turned off. The turned-on eighth transistor M8 provides the signal from the reference signal terminal VSS to the signal output terminal Output, so that the signal output from the signal output terminal Output is the low-level signal.

Generally, within the display time of a frame, scanning can be performed to display a picture. Blanking time may also be set between the display time of two adjacent frames. In specific implementation, the frame reset phase T5 may be set in the blanking time.

Moreover, when the temperature of the device in which the shift register unit is located rises, the change amounts ΔVth of the threshold voltages of the third transistor M3 and the fifth transistor M5 increase. In the present disclosure, since the dielectric layer of the second capacitor C2 is made from the liquid crystal material, the dielectric constant of the liquid crystal material decreases with the rising temperature, and thus the capacitance value of the second capacitor C2 decreases, and further the voltage of the first node PU is reduced in the input phase and the output phase, the voltages of the gates of the third transistor M3 and the fifth transistor M5 decrease accordingly, and the change amounts ΔVth of the threshold voltages of the third transistor M3 and the fifth transistor M5 decrease, so that the stability of the third transistor M3 and the fifth transistor M5 is improved so as to enable the signal output terminal to stably output the signal, and the service life of the shift register unit is prolonged.

Figure 9:
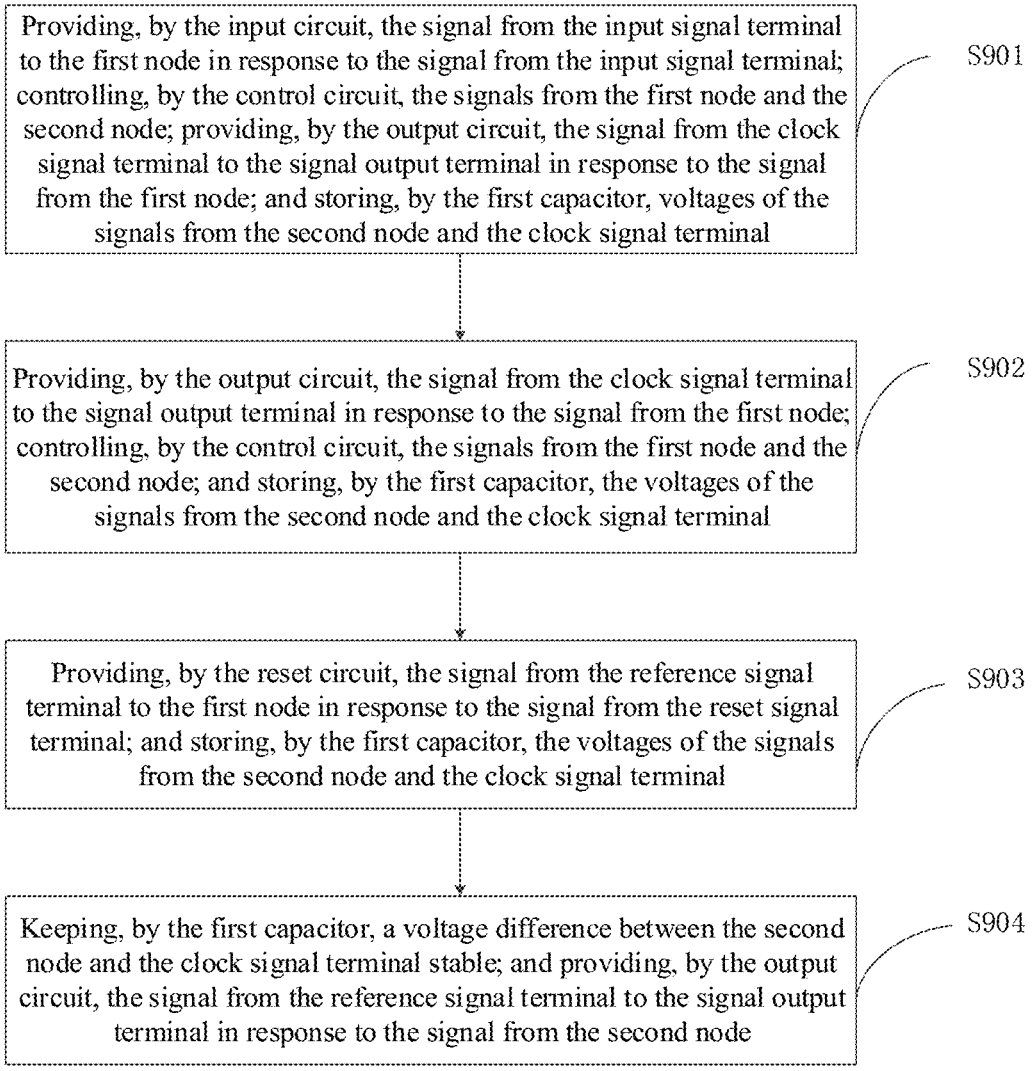
FIG. 9 is a flow diagram of a driving method of a shift register unit provided by an embodiment of the present disclosure.

Based on the same inventive concept, an embodiment of the present disclosure provides a driving method for the above shift register unit, as shown in FIG. 9, including:

S901, in the input phase, providing, by the input circuit, the signal from the input signal terminal to the first node in response to the signal from the input signal terminal; controlling, by the control circuit, the signals from the first node and the second node; providing, by the output circuit, the signal from the clock signal terminal to the signal output terminal in response to the signal from the first node; and storing, by the first capacitor, voltages of the signals from the second node and the clock signal terminal;

S902, in the output phase, providing, by the output circuit, the signal from the clock signal terminal to the signal output terminal in response to the signal from the first node; controlling, by the control circuit, the signals from the first node and the second node; and storing, by the first capacitor, voltages of the signals from the second node and the clock signal terminal; and S903, in the reset phase, providing, by the reset circuit, the signal from the reference signal terminal to the first node in response to the signal from the reset signal terminal; and storing, by the first capacitor, the voltages of the signals from the second node and the clock signal terminal; and S904, in the reset-maintaining phase, keeping, by the first capacitor, the voltage difference between the second node and the clock signal terminal stable; and providing, by the output circuit, the signal from the reference signal terminal to the signal output terminal in response to the signal from the second node.

Figure 10:
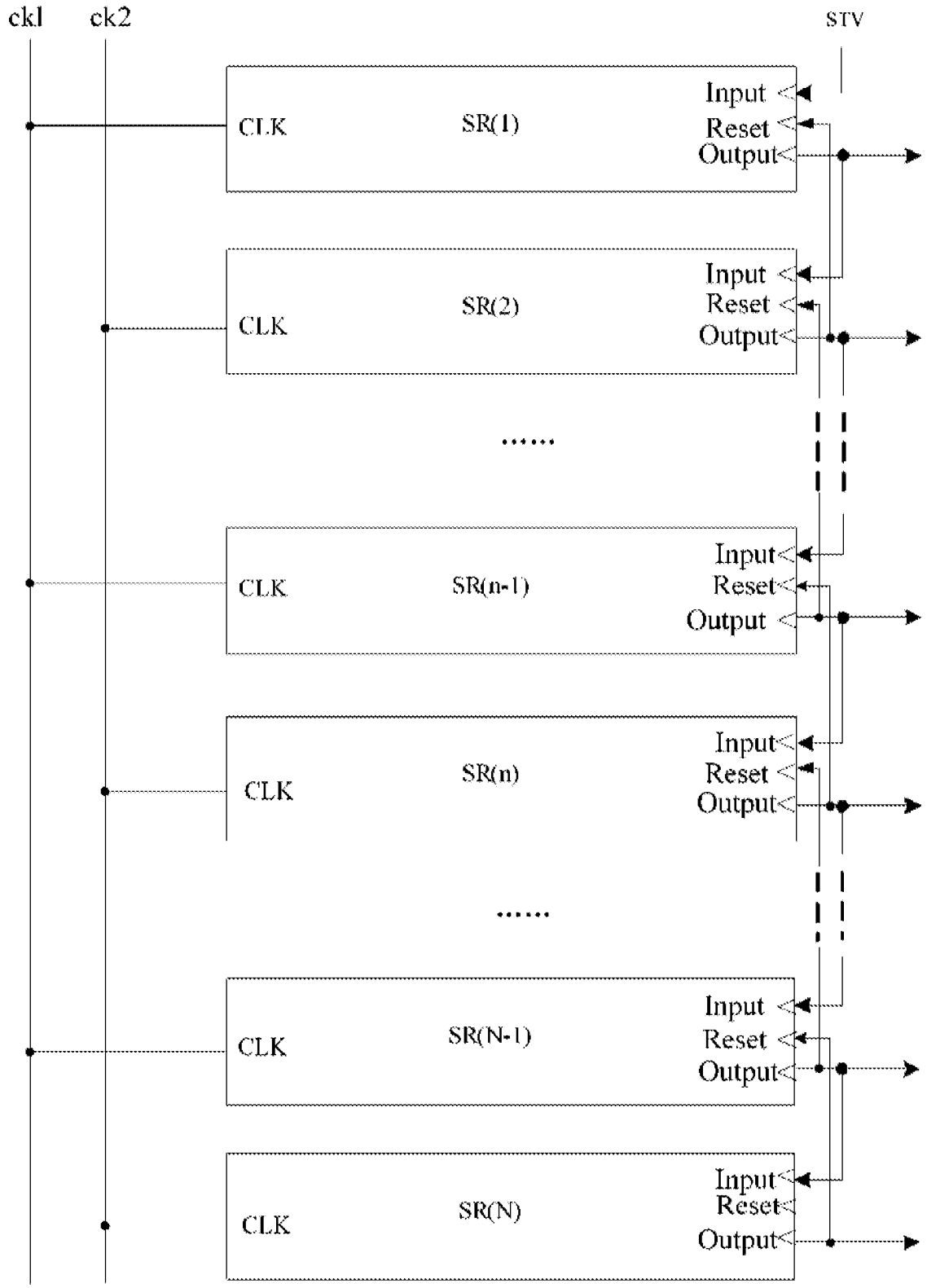
FIG. 10 is a structural schematic diagram of a gate driving circuit provided by an embodiment of the present disclosure.

Based on the same inventive concept, an embodiment of the present disclosure further provides a gate driving circuit, as shown in FIG. 10, including a plurality of cascaded shift register units SR (1), SR (2) . . . SR (n−1), SR (n) . . . SR (N−1), and SR (N) (N shift registers in total, 1≤n≤N), where N is the total number of shift register units in the gate driving circuit;

an input signal terminal Input of a first-stage shift register unit SR(1) is coupled to a frame trigger signal terminal STV;

in every adjacent two stages of shift register units, an input signal terminal Input of a next-stage shift register unit SR(n+1) is coupled to a signal output terminal Output of a prior-stage shift register unit SR(n); and in every adjacent two stages of shift register units, an output signal terminal Output of a next-stage shift register unit SR(n+1) is coupled to a reset signal terminal Reset of a prior-stage shift register unit. The specific structure of each shift register unit in the above gate driving circuit is functionally and structurally same as the specific structure of the above shift register unit in the present disclosure, and repeated parts are not described herein.

Optionally, the specific structure of each shift register unit in the above gate driving circuit is functionally and structurally same as the specific structure of the above shift register unit in the present disclosure, and repeated parts are not described herein. The gate driving circuit may be applied to a liquid crystal display panel, and may also be applied an organic electroluminescent display panel, which is not limited herein.

Optionally, in the above gate driving circuit provided by the embodiment of the present disclosure, reference signal terminals of the stages of shift register units are connected to a same DC signal terminal.

Optionally, in the above gate driving circuit provided by the embodiment of the present disclosure, as shown in FIG. 10, the clock signal terminal CLK of the 2k−1-th level shift register unit is connected to a same clock terminal, that is, a first clock terminal ck1; and the clock signal terminal CLK of the 2k-th level shift register unit is connected to a same clock terminal, that is, a second clock terminal ck2, where k is a positive integer.

Based on the same inventive concept, an embodiment of the present disclosure further provides a display device, including the above gate driving circuit provided by the embodiment of the present disclosure.

Figure 11:
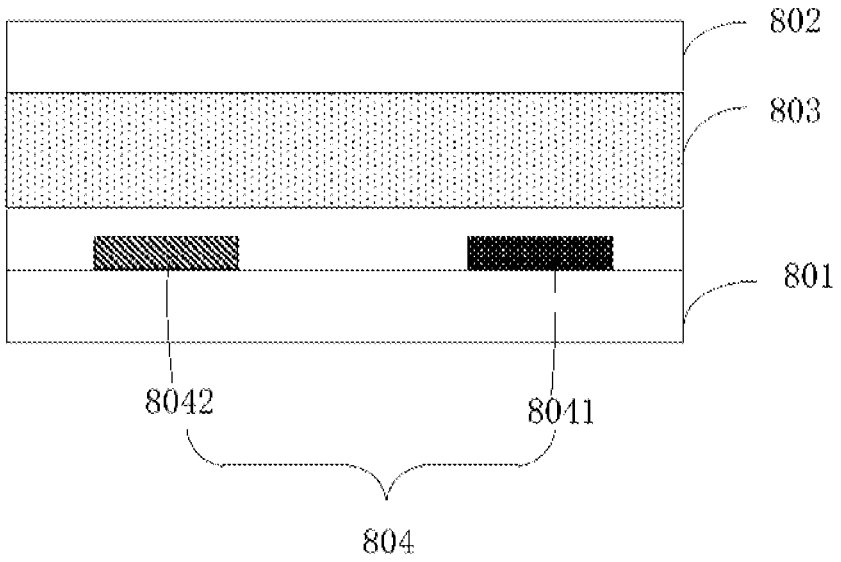
FIG. 11 is a structural schematic diagram of a display device provided by an embodiment of the present disclosure.

In specific implementation, in the display device provided by the embodiment of the present disclosure, as shown in FIG. 11, the display device further includes an array substrate 801 and an opposite substrate 802 arranged opposite to each other, a liquid crystal layer 803 encapsulated between the array substrate 801 and the opposite substrate 802, a first electrode layer 804 located between the liquid crystal layer 803 and the array substrate 801, and a clock signal line electrically connected to the clock signal terminal;

the first electrode layer 804 includes first electrodes 8041 and second electrodes 8042 in one-to-one corresponding to the shift register units, where in the same shift register unit, the first electrodes 8041 are electrically connected to the clock signal line, and the second electrodes 8042 are electrically connected to the second node; and in the same shift register unit, the first electrode 8041, the second electrode 8042 and the liquid crystal layer 803 are equivalent to the first capacitor. As the dielectric layer of the first capacitor C1 is made from the liquid crystal material, the dielectric constant of the liquid crystal material decreases when the temperature of the device in which the first capacitor C1 is located rises, and thus the capacitance value of the first capacitor C1 decreases. The decrease of the capacitance value of the first capacitor C1 can reduce the voltage of the second node PD. As the voltage of the second node PD decreases, the voltages of the gates of the second transistor M2 and the sixth transistor M6 decrease, drift speeds of the threshold voltages of the second transistor M2 and the sixth transistor M6 decrease, and therefore the stability of the transistors is improved, and further the service lives of the shift register units are prolonged.

Figure 12:
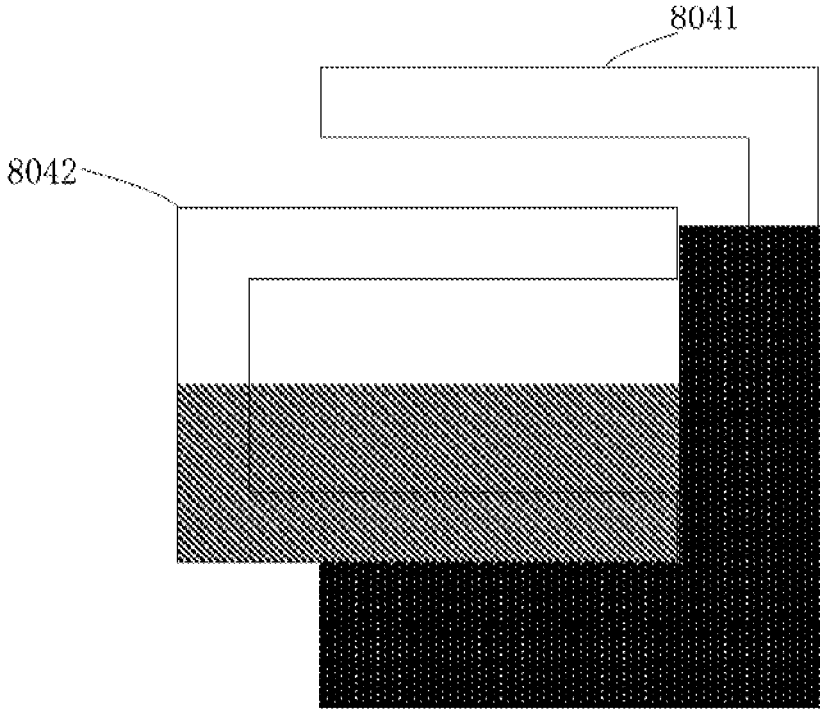
FIG. 12 is a structural schematic diagram of a first electrode layer provided by an embodiment of the present disclosure.

In specific implementation, in the display device provided by the embodiment of the present disclosure, as shown in FIG. 12, the first electrodes and the second electrodes are respectively interdigitated electrodes.

Figure 13:
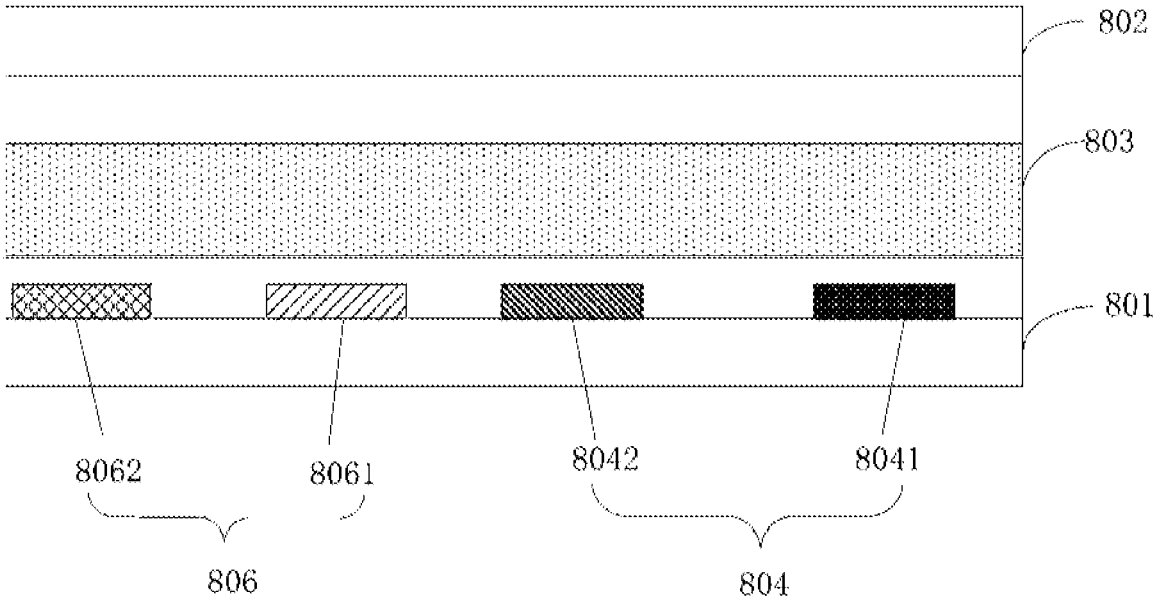
FIG. 13 is a structural schematic diagram of another display device provided by an embodiment of the present disclosure.

In specific implementation, in the display device provided by the embodiment of the present disclosure, as shown in FIG. 13, the display device further includes a second electrode layer 806 arranged to be insulated from the first electrode layer;

the second electrode layer 806 includes third electrodes 8061 and fourth electrodes 8062 in one-to-one corresponding to the shift register units, where in the same shift register unit, the third electrodes 8061 are electrically connected to the first node, and the fourth electrodes 8062 are electrically connected to the signal output terminal; and in the same shift register unit, the third electrodes 8061, the fourth electrodes 8062 and the liquid crystal layer 803 are equivalent to the second capacitor. As the dielectric layer of the second capacitor C2 is made from the liquid crystal material, the dielectric constant of the liquid crystal material decreases when the temperature of the device in which the second capacitor C2 is located rises, and thus the capacitance value of the second capacitor C2 decreases to cause the voltage of the first node PU to decrease. As the voltage of the first node PU decreases, the voltages of the gates of the third transistor M3 and the fifth transistor M5 decrease, so that drift speeds of the threshold voltages of the third transistor M3 and the fifth transistor M5 decrease, the stability of the transistors is improved, and the service lives of the shift register units are prolonged.

Figure 14:
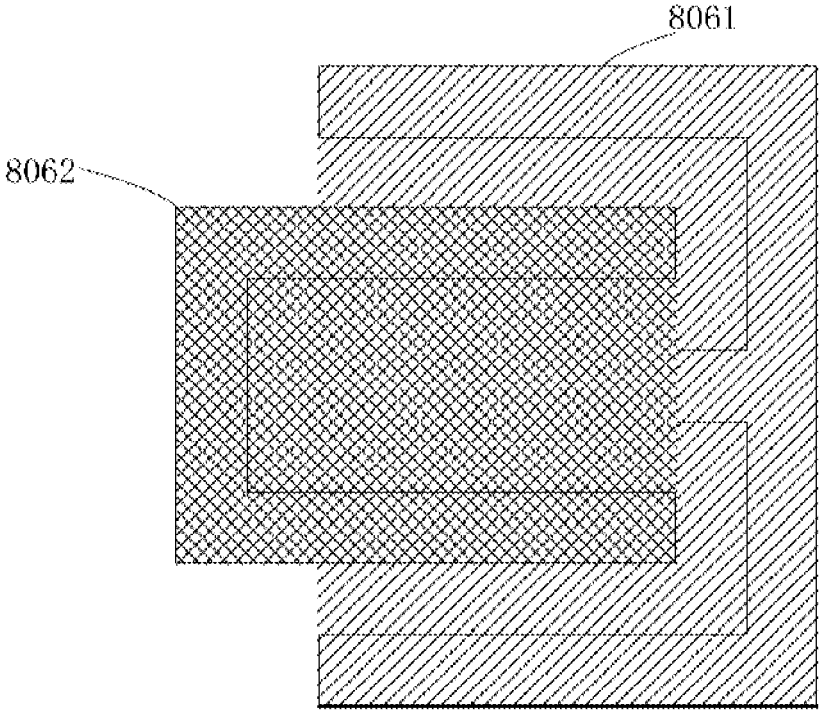
FIG. 14 is a structural schematic diagram of a second electrode layer provided by an embodiment of the present disclosure.

In specific implementation, in the display device provided by the embodiment of the present disclosure, as shown in FIG. 14, the third electrodes 8061 and the fourth electrodes 8062 are respectively interdigitated electrodes.

The second electrode layer 806 and the first electrode layer 804 can be arranged in the same layer, made from the same material, and insulated from each other, there is no need of an additional process for preparing the second electrode layer 806, and patterns of the first electrode layer 804 and the second electrode layer 806 can be formed by a one-time patterning process, so that the manufacturing process can be simplified, the manufacturing cost is saved and the production efficiency is improved. Of course, the second electrode layer 806 may also be arranged in a different layer from the first electrode layer 804. The positions of the second electrode layer 806 and the first electrode layer 804 can be set according to actual needs, which is not specifically limited in the present disclosure.

The problem-solving principle of the display device is similar to that of the above shift register, and thus the implementation of the display device can refer to the implementation of the above shift register, and repeated parts are not described herein.

In specific implementation, the above display device provided by the embodiment of the present disclosure may be an organic light-emitting display device, and may also be a liquid crystal display device, which is not limited herein.

Figure 15:
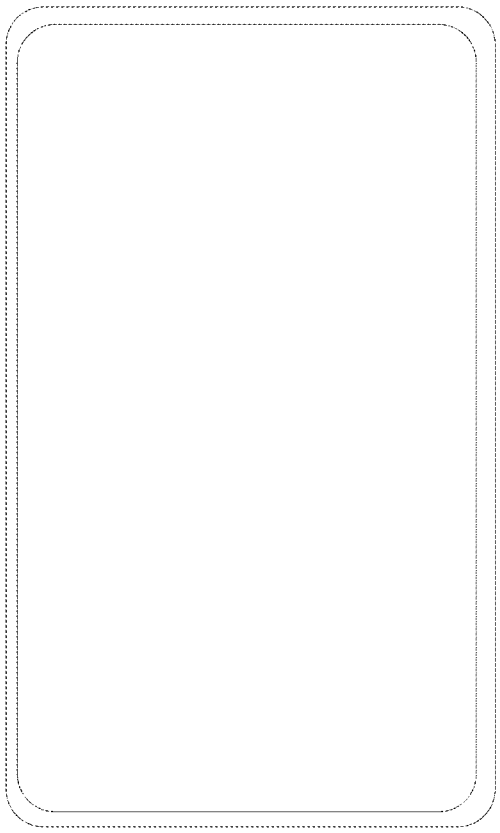
FIG. 15 is a structural schematic diagram of a full-screen mobile phone provided by an embodiment of the present disclosure.

In specific implementation, the above display device provided by the embodiment of the present disclosure may be a full-screen mobile phone as shown in FIG. 15. Of course, the above display device provided by the embodiment of the present disclosure may be a tablet computer, a television, a display, a notebook computer, a digital photo frame, a navigator, or any other product or component with a display function. The presence of other indispensable components of the display device should be understood by those skilled in the art, which is not described herein, and should not be construed as limitation on the present disclosure.

In the shift register unit, the driving method thereof, the gate driving circuit, and the display device provided by the embodiments of the present disclosure, the shift register unit includes the input circuit, the control circuit, the reset circuit, the output circuit and the first capacitor, where the input circuit is configured to provide the signal from the input signal terminal to the first node in response to the signal from the input signal terminal; the control circuit is configured to control the signals from the first node and the second node; the reset circuit is configured to provide the signal from the reference signal terminal to the first node in response to the signal from the reset signal terminal; the output circuit is configured to provide the signal from the clock signal terminal to the signal output terminal in response to the signal from the first node, and provide the signal from the reference signal terminal to the signal output terminal in response to the signal from the second node; and the first capacitor C1 is coupled between the clock signal terminal and the second node. Therefore, compared with a shift register unit that controls a signal from a second node through a plurality of transistors in the prior art, the shift register unit provided by the embodiment of the present disclosure can achieve the effects that, through mutual cooperation of the input circuit, the control circuit, the reset circuit, the output circuit and the first capacitor, in the reset-maintaining phase, the shift register unit can pull up the level of the signal from the second node through the first capacitor, and then control, through the high-level signal from the second node, the signal output terminal to stably output the signal. Moreover, when the device in which the shift register unit is located is at a high temperature, the life of the shift register unit can be prolonged. Furthermore, the shift register unit of the present disclosure can achieve the control of the second node in the reset-maintaining phase only by using the first capacitor. Compared with controlling the second node by using at least two transistors, the shift register unit is simple in structure, can reduce the process complexity and the manufacturing cost, and is beneficial to achieving a narrow frame design of a panel in the display device.

Apparently, those skilled in the art can make changes and modifications to the present disclosure without departing from the spirit and scope of the present disclosure. In this way, the present disclosure is also intended to encompass these changes and modifications if such changes and modifications of the present disclosure are within the scope of the claims of the present disclosure and equivalent technologies thereof.

The invention claimed is:

1. A shift register unit, comprising:

an input circuit configured to provide a signal from an input signal terminal to a first node in response to the signal from the input signal terminal;

a control circuit configured to control signals from the first node and a second node;

a reset circuit configured to provide a signal from a reference signal terminal to the first node in response to a signal from a reset signal terminal;

an output circuit configured to provide a signal from a clock signal terminal to a signal output terminal in response to the signal from the first node, and provide the signal from the reference signal terminal to the signal output terminal in response to the signal from the second node; and a first capacitor coupled between the clock signal terminal and the second node;

wherein a dielectric layer of the first capacitor is made from a liquid crystal material.

2. The shift register unit according to claim 1, wherein the input circuit comprises a first transistor, the first transistor having a gate coupled to the input signal terminal, a first electrode coupled to the input signal terminal, and a second electrode coupled to the first node; and/or the control circuit comprises a second transistor and a third transistor, the second transistor having a gate coupled to the second node, a first electrode coupled to the reference signal terminal, and a second electrode coupled to the first node, and the third transistor having a gate coupled to the first node, a first electrode coupled to the reference signal terminal, and a second electrode coupled to the second node.

3. The shift register unit according to claim 1, wherein the reset circuit comprises a fourth transistor, the fourth transistor having a gate coupled to the reset signal terminal, a first electrode coupled to the reference signal terminal, and a second electrode coupled to the first node; and/or the output circuit comprises a fifth transistor, a sixth transistor and a second capacitor, the fifth transistor having a gate coupled to the first node, a first electrode coupled to the clock signal terminal, and a second electrode coupled to the signal output terminal;

the sixth transistor having a gate coupled to the second node, a first electrode coupled to the reference signal terminal, and a second electrode coupled to the signal output terminal; and the second capacitor being coupled between the first node and the signal output terminal.

4. The shift register unit according to claim 3, wherein a dielectric layer of the second capacitor is made from a liquid crystal material.

5. The shift register unit according to claim 1, further comprises: a frame reset circuit, the frame reset circuit being configured to provide the signal from the reference signal terminal to the first node and the signal output terminal respectively in response to a signal from a frame reset signal terminal.

6. The shift register unit according to claim 5, wherein the frame reset signal terminal comprises a seventh transistor and an eighth transistor, the seventh transistor having a gate coupled to the frame reset signal terminal, a first electrode coupled to the reference signal terminal, and a second electrode coupled to the first node; and the eighth transistor having a gate coupled to the frame reset signal terminal, a first electrode coupled to the reference signal terminal, and a second electrode coupled to the signal output terminal.

7. A gate driving circuit, comprising a plurality of shift register units cascaded as claimed in claim 1, wherein an input signal terminal of a first-level shift register unit is coupled to a frame trigger signal terminal;

in every two adjacent levels of shift register units, an input signal terminal of a next-level shift register unit is coupled to a signal output terminal of a prior-level shift register unit; and in every two adjacent levels of shift register units, an output signal terminal of a next-stage shift register unit is coupled to a reset signal terminal of a prior-stage shift register unit.

8. The gate driving circuit according to claim 7, wherein the input circuit comprises a first transistor, the first transistor having a gate coupled to the input signal terminal, a first electrode coupled to the input signal terminal, and a second electrode coupled to the first node; and/or the control circuit comprises a second transistor and a third transistor, the second transistor having a gate coupled to the second node, a first electrode coupled to the reference signal terminal, and a second electrode coupled to the first node, and the third transistor having a gate coupled to the first node, a first electrode coupled to the reference signal terminal, and a second electrode coupled to the second node.

9. The gate driving circuit according to claim 7, wherein the reset circuit comprises a fourth transistor, the fourth transistor having a gate coupled to the reset signal terminal, a first electrode coupled to the reference signal terminal, and a second electrode coupled to the first node; and/or the output circuit comprises a fifth transistor, a sixth transistor and a second capacitor, the fifth transistor having a gate coupled to the first node, a first electrode coupled to the clock signal terminal, and a second electrode coupled to the signal output terminal;

the sixth transistor having a gate coupled to the second node, a first electrode coupled to the reference signal terminal, and a second electrode coupled to the signal output terminal; and the second capacitor being coupled between the first node and the signal output terminal.

10. The gate driving circuit according to claim 9, wherein a dielectric layer of the second capacitor is made from a liquid crystal material.

11. The gate driving circuit according to claim 7, wherein the shift register unit further comprises: a frame reset circuit, the frame reset circuit being configured to provide the signal from the reference signal terminal to the first node and the signal output terminal respectively in response to a signal from a frame reset signal terminal.

12. The gate driving circuit according to claim 11, wherein the frame reset signal terminal comprises a seventh transistor and an eighth transistor, the seventh transistor having a gate coupled to the frame reset signal terminal, a first electrode coupled to the reference signal terminal, and a second electrode coupled to the first node; and the eighth transistor having a gate coupled to the frame reset signal terminal, a first electrode coupled to the reference signal terminal, and a second electrode coupled to the signal output terminal.

13. A display device, comprising the gate driving circuit as claimed in claim 7.

14. The display device according to claim 13, further comprises: an array substrate and an opposite substrate arranged opposite to each other, a liquid crystal layer encapsulated between the array substrate and the opposite substrate, a first electrode layer located between the liquid crystal layer and the array substrate, and a clock signal line electrically connected to the clock signal terminal; and the first electrode layer comprises first electrodes and second electrodes in one-to-one corresponding to the shift register units, where in a same shift register unit, the first electrodes are electrically connected to the clock signal line, and the second electrodes are electrically connected to the second node; and in the same shift register unit, the first electrode, the second electrode and the liquid crystal layer are equivalent to the first capacitor.

15. The display device according to claim 14, wherein the first electrodes and the second electrodes are interdigitated electrodes respectively.

16. The display device according to claim 14, further comprises a second electrode layer arranged to be insulated from the first electrode layer;

the second electrode layer comprises third electrodes and fourth electrodes in one-to-one corresponding to the shift register units, where in a same shift register unit, the third electrodes are electrically connected to the first node, and the fourth electrodes are electrically connected to the signal output terminal; and in the same shift register unit, the third electrodes, the fourth electrodes and the liquid crystal layer are equivalent to the second capacitor.

17. The display device according to claim 16, wherein the third electrodes and the fourth electrodes are interdigitated electrodes respectively.

18. A driving method of the shift register unit as claimed in claim 1, comprising:

in an input phase, providing, by the input circuit, the signal from the input signal terminal to the first node in response to the signal from the input signal terminal; controlling, by the control circuit, the signals from the first node and the second node; providing, by the output circuit, the signal from the clock signal terminal to the signal output terminal in response to the signal from the first node; and storing, by the first capacitor, voltages of the signals from the second node and the clock signal terminal;

in an output phase, providing, by the output circuit, the signal from the clock signal terminal to the signal output terminal in response to the signal from the first node; controlling, by the control circuit, the signals from the first node and the second node; and storing, by the first capacitor, the voltages of the signals from the second node and the clock signal terminal;

in a reset phase, providing, by the reset circuit, the signal from the reference signal terminal to the first node in response to the signal from the reset signal terminal; and storing, by the first capacitor, the voltages of the signals from the second node and the clock signal terminal; and in a reset-maintaining phase, keeping, by the first capacitor, a voltage difference between the second node and the clock signal terminal stable; and providing, by the output circuit, the signal from the reference signal terminal to the signal output terminal in response to the signal from the second node.

* * * * *